US012471644B2

(12) United States Patent
Mapen et al.

(10) Patent No.: US 12,471,644 B2
(45) Date of Patent: Nov. 18, 2025

(54) EXTREMITY HEATER

(71) Applicant: CARDINAL ENGINEERING LLC, Annapolis, MD (US)

(72) Inventors: Barry E. Mapen, Stonington, CT (US); Christian A. Whitney, Chester, CT (US); Kevin P. Richards, Narragansett, RI (US)

(73) Assignee: CARDINAL ENGINEERING LLC, Annapolis, IN (US)

( * ) Notice: Subject to any disclaimer, the term of this patent is extended or adjusted under 35 U.S.C. 154(b) by 758 days.

(21) Appl. No.: 17/636,167

(22) PCT Filed: Aug. 10, 2020

(86) PCT No.: PCT/US2020/045616

§ 371 (c)(1),
(2) Date: Feb. 17, 2022

(87) PCT Pub. No.: WO2021/034529

PCT Pub. Date: Feb. 25, 2021

(65) Prior Publication Data

US 2022/0279870 A1 Sep. 8, 2022

Related U.S. Application Data

(60) Provisional application No. 62/890,014, filed on Aug. 21, 2019.

(51) Int. Cl.

| | |
|---|---|
| ***A41D 13/005*** | (2006.01) |
| ***A41D 13/05*** | (2006.01) |
| ***A41D 13/08*** | (2006.01) |

(52) U.S. Cl.

CPC ..... *A41D 13/0051* (2013.01); *A41D 13/0543* (2013.01); *A41D 13/08* (2013.01)

(58) Field of Classification Search

CPC ..... A41D 13/0051; A41D 13/0543; A41D 13/08; A41D 31/02; A41D 31/06; A41D 31/12

(Continued)

(56) References Cited

U.S. PATENT DOCUMENTS

2013/0037531 A1* 2/2013 Gray ..... A41D 13/0051 219/211
2015/0335472 A1 11/2015 Li et al.

(Continued)

FOREIGN PATENT DOCUMENTS

JP 2003049305 A * 2/2003
JP 2004012685 A 1/2004

(Continued)

OTHER PUBLICATIONS

Extended European Search Report issued in Application No. EP20854928.7 dated Jul. 21, 2023; 6 pages.

(Continued)

*Primary Examiner* — Allen R. B. Schult
*Assistant Examiner* — William C Weinert
(74) *Attorney, Agent, or Firm* — CANTOR COLBURN LLP

(57) ABSTRACT

Disclosed is a heating system including: a heating garment formed as a tubular sleeve, the heating garment configured for being worn on a limb, having a cylindrical shape, a proximate end, a distal end that is axially spaced from the proximate end, a dorsal side, a ventral side that radially opposes the dorsal side, a proximate opening at the proximate end, and a distal opening at the distal end, wherein the heating garment is configured for being slid over the limb so that the proximate end is at a wrist or ankle, the distal end is near an elbow or knee, the dorsal side covers a dorsal side of the limb and the ventral side covers a ventral side of the (Continued)

limb, the heating garment including an infrared radiation (IR) heating source that distributes IR heat along at least a portion of the heating garment.

20 Claims, 7 Drawing Sheets

(58) Field of Classification Search
USPC ..... 126/204
See application file for complete search history.

(56) References Cited

U.S. PATENT DOCUMENTS

| | | | | |
|---|---|---|---|---|
| 2017/0196275 | A1* | 7/2017 | Tam | A41D 13/0051 |
| 2017/0367917 | A1 | 12/2017 | Donat et al. | |
| 2018/0103694 | A1* | 4/2018 | Fortenbacher | A41D 13/0051 |
| 2018/0255847 | A1* | 9/2018 | Gueritee | A41D 19/01535 |
| 2018/0280190 | A1* | 10/2018 | Betkowski | A41D 13/0051 |
| 2020/0214369 | A1* | 7/2020 | Winningham | A41D 13/08 |

FOREIGN PATENT DOCUMENTS

| | | | | |
|---|---|---|---|---|
| JP | 2019023366 | A | 2/2019 | |
| KR | 20130037892 | A | 4/2013 | |
| KR | 20150059570 | A | 6/2015 | |
| SE | 1651634 | A1 | 6/2018 | |
| WO | WO-2009056296 | A1 * | 5/2009 | A41D 13/0056 |
| WO | 2019108138 | A1 | 6/2019 | |

OTHER PUBLICATIONS

International Search Report mailed Nov. 20, 2020 for International Application No. PCT/US20/45616.
Written Opinion mailed Nov. 20, 2020 for International Application No. PCT/US20/45616.
Office Action issued in Japanese Application No. 2022-511265 dated May 7, 2024 with English Summary.
Notice of Non-Final Rejection issued in Korean Application No. 10-2022-7009337; dated Nov. 28, 2024 (with English translation); 60 pages.

* cited by examiner

Simultaneous powering of layers
Sequenced with no overlap
Infrared Deep Heaters
Surface Heaters
Combined Heating
Reduced peak power
Power
Time
FIG. 3A1
FIG. 3A2
FIG. 3B1
FIG. 3B2
FIG. 3C1
FIG. 3C2

EXTREMITY HEATER

CROSS REFERENCE TO RELATED APPLICATIONS

This application is a § 371 of International Application No. PCT/US20/45616, filed on Aug. 10, 2020, which claims the benefit of U.S. Provisional Application No. 62/890,014, filed on Aug. 21, 2019, the disclosures of each of which are incorporated herein by reference in their entirety.

BACKGROUND

The embodiments herein are related to body warming systems and more specifically to extremity warmers worn proximate to an extremity.

Extremities (e.g., hands or feet) are subject to degraded functionality including dexterity, strength, and tactile sensations if they become too cold. Temperature losses in these extremities may be caused by conductive, convective, radiated, and evaporative thermal losses to the surrounding environment.

One existing method to prevent degraded functionality due to temperature is to cover the extremity with localized discrete insulation implements such as gloves or mittens, which may be passive or active systems. Such covering material may reduce the function, including dexterity or tactile sensitivity of the extremity.

Another method uses actively heated core warmers (e.g., heated jackets). Warming the larger core requires more energy than warming a smaller extremity resulting in a less efficient system than the present disclosure. The amount of heat that can be transferred to the extremities is limited by the maximum acceptable core temperature. Attempting to raise to the core temperature further can cause discomfort or injury to the wearer. This inherently limits the ability of the system to maintain extremity function in lower temperature environments. In addition, core heating may result in perspiration in some areas of the wearer. Perspiration can lead to evaporative cooling in those areas further reducing the efficiency of the overall system.

SUMMARY OF THE DISCLOSED EMBODIMENTS

Disclosed is a heating system comprising: a heating garment formed as a tubular sleeve, the heating garment configured for being worn on a limb, having a cylindrical shape, a proximate end, a distal end that is axially spaced from the proximate end, a dorsal side and a ventral side that radially opposes the dorsal side, a proximate opening at the proximate end, and a distal opening at the distal end, wherein the heating garment is configured for being slid over the limb so that the proximate end is at a wrist or ankle, the distal end is near an elbow or knee, the dorsal side covers a dorsal side of the limb and the ventral side covers a ventral side of the limb, the heating garment including an infrared radiation (IR) heating source that distributes IR heat along at least a portion of the heating garment.

In addition to one or more above disclosed aspects or as an alternate the IR heating source is distributed in one or both of a first pattern and a second pattern, the first pattern being linear and extending between the proximate end and the distal end of the ventral side of the heating garment, the second pattern being linear and extending about the proximate end of the ventral side of the heating garment.

In addition to one or more above disclosed aspects or as an alternate, the IR heating source is distributed in both of the first pattern and the second pattern, wherein the first pattern and the second pattern are approximately perpendicular with respect to each other.

In addition to one or more above disclosed aspects or as an alternate, the heating garment includes IR heating shielding distributed radially exterior to the IR heating source.

In addition to one or more above disclosed aspects or as an alternate, the system includes a proximate-extending dorsal section extending from the proximate end of the dorsal side, the proximate-extending dorsal section being configured for extending over a dorsal side of a hand when worn on an arm; and a fabric loop extending from a proximate end of the proximate-extending dorsal section, the fabric loop configured for being looped about a finger when worn on the arm, to thereby securely position the proximate-extending dorsal section against the proximate side of the hand when worn on the arm.

In addition to one or more above disclosed aspects or as an alternate, the system includes a controller that is a thermal regulation controller, the controller being operationally connected to the IR heating source, the controller controlling operational parameters of the IR heating source including one or more of activation/deactivation, duration of activation/deactivation, and power intensity, wherein the controller is adjustably securable to the heating garment.

In addition to one or more above disclosed aspects or as an alternate, the heating garment includes a conduction heat source that conducts heat along at least a portion of the heating garment, wherein the controller is operationally connected to the conduction heat source, the controller controlling operational parameters of the conduction heat source including one or more of activation/deactivation, duration of activation/deactivation, and power intensity.

In addition to one or more above disclosed aspects or as an alternate, the controller is configured to applying power cycles to the IR heat source and the conduction heat source that are timewise alternating or timewise synchronized.

In addition to one or more above disclosed aspects or as an alternate, the heating garment includes a moisture wicking layer disposed radially inward of each of the heating sources.

In addition to one or more above disclosed aspects or as an alternate, the system includes one or more sensors operationally connected to the controller and removed from the heating garment, wherein the controller controls each of the heating sources responsive to temperature of skin sensed by the one or more sensors.

In addition to one or more above disclosed aspects or as an alternate, the system includes a plurality of the heating garments configured for being worn on a plurality of limbs, each of the plurality of heating garments being operationally connected to the controller.

Further disclosed is a clothing garment that includes one more of the above disclosed aspects, wherein wires interconnect the plurality of heating garments and the controller, and wherein the wires are embedded in the clothing garment.

Further disclosed is a method of distributing heat to an extremity comprising: sliding a heating garment, formed as a tubular sleeve, over a limb so that a proximate end of the heating garment is at a wrist or ankle, a distal end of the heating garment is near an elbow or knee, a dorsal side of the heating garment is against a dorsal side of the limb and a ventral side of the heating garment is against a ventral side of the limb; and activating an infrared (IR) source embedded in the heating garment and controlling one or more of activation/deactivation, duration of activation/deactivation, and power intensity of the IR heating source.

In addition to one or more above disclosed aspects or as an alternate, the method includes shielding against IR emissions by the heating garment from a location radially exterior to the IR heating source.

In addition to one or more above disclosed aspects or as an alternate, the method includes one or more of: wicking perspiration away from the arm by the heating garment from a location that is radially between each heating source and the skin; and placing a proximate-extending dorsal section against dorsal side of hand when worn on an arm and fabric loop over finger to securely position the proximate-extending dorsal against hand.

In addition to one or more above disclosed aspects or as an alternate, the method includes activating a conduction heat source embedded in the heating garment and controlling one or more of activation/deactivation, duration of activation/deactivation, and power intensity of the conduction heat source.

In addition to one or more above disclosed aspects or as an alternate, the method includes insulating against conduction heat loss by the heating garment from a location radially exterior to the conduction heat source.

In addition to one or more above disclosed aspects or as an alternate, the method includes applying power cycles to the IR heat source and the conduction heat source that are timewise alternating or timewise synchronized.

In addition to one or more above disclosed aspects or as an alternate, the method includes controlling one or more of activation/deactivation, duration of activation/deactivation, and power intensity of each of the heating sources responsive to skin temperature sensed by one or more sensors.

In addition to one or more above disclosed aspects or as an alternate, the method includes sliding a plurality of the heating garments over a respective plurality of limbs, and controlling one or more of activation/deactivation, duration of activation/deactivation, and power intensity of the IR heating source with a single controller operationally connected to each of the plurality of heating garments.

BRIEF DESCRIPTION OF THE FIGURES

The present disclosure is illustrated by way of example and not limited to the depictions in the accompanying figures in which like reference numerals indicate similar elements.

FIGS. 3A1-3C2 are graphs of power draws, by layer and total, for the system;

DETAILED DESCRIPTION

Aspects of the disclosed embodiments will now be addressed with reference to the figures. Aspects in any one figure is equally applicable to any other figure unless otherwise indicated. Aspects illustrated in the figures are for purposes of supporting the disclosure and are not in any way intended on limiting the scope of the disclosed embodiments. Any sequence of numbering in the figures is for reference purposes only.

The body, hands, and circulatory system function similarly to a forced water heating system. A heat source, like a furnace, warms the water which is circulated through the house releasing heat as it passes in each room through registers or radiators, e.g., metal heat fins that dissipate heat from a heating loop into surrounding air.

In the human body, the heat source is metabolic activity in the torso which warms blood circulating through veins and arteries. Heat is released in the capillaries like high surface area registers that move heat from the circulating water into the room air. Similarly to the insulation of a house, the skin partially acts as a conductive insulator that helps retain heat in both the torso and hands. When the heat flowing into the hands is less than the heat leaching through the insulation, then the hands eventually get cold. To warm the hands there must be a net heat gain in the hands. This means the heat energy provided to the hands, temperature differential and flow rate, must exceed the thermal losses occurring in the hands.

Taken separately, either improving the efficacy of the heating supply or reducing losses though the system will help the overall efficiency of the system. The heating supply may be improved by the use of active heating implements. Likewise, if heat losses are reduced, then active heating implements may be made smaller and more efficient. The net result is reduced heat loss to the surrounding environment and more heat retained and conveyed from the arm to the hands to counteract their heat loss.

Figure 1:
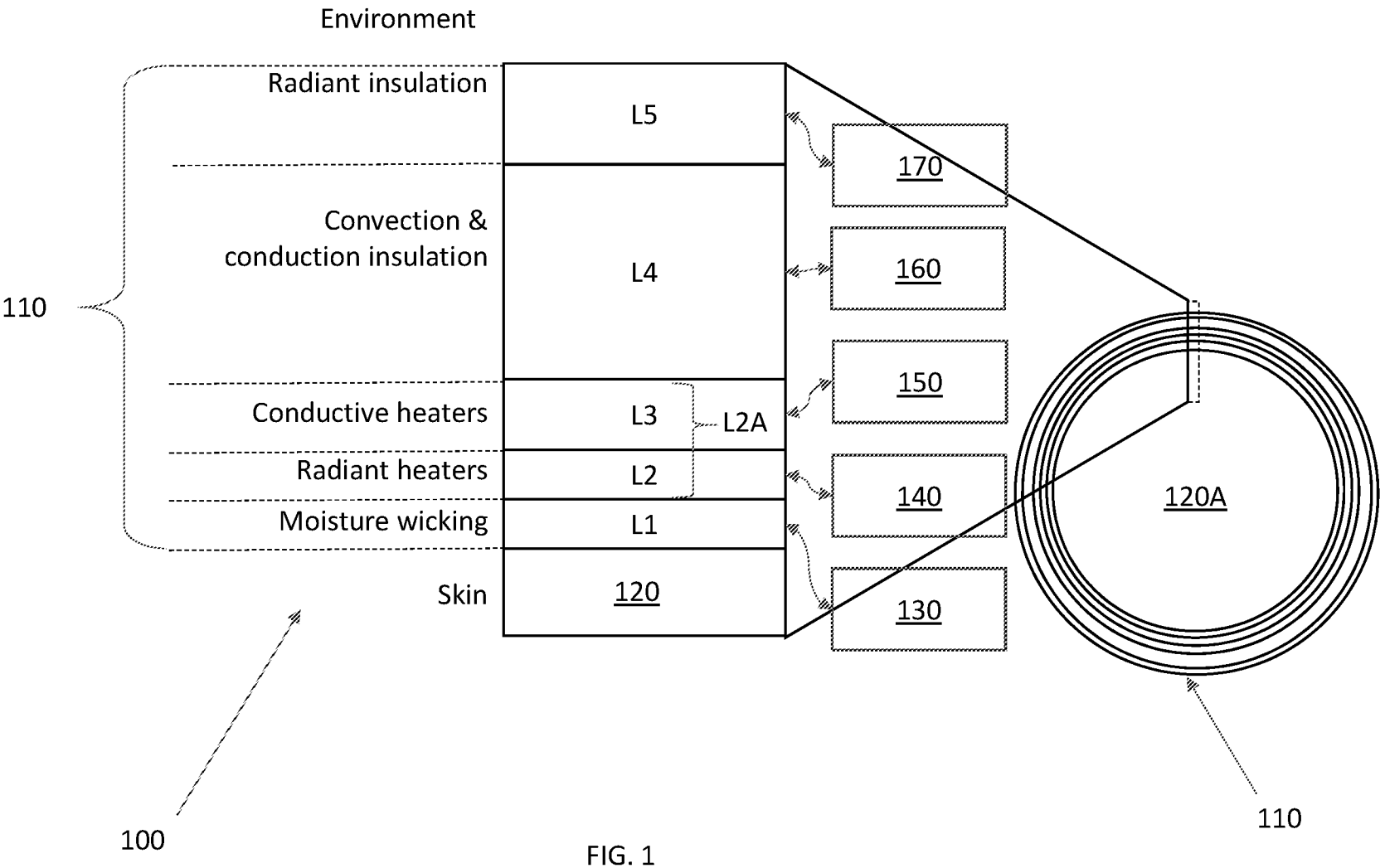
FIG. 1 shows a one-dimensional thermal model for heating an extremity according to the disclosure.

FIG. 1 is a cross sectional view of an embodiment of a forearm heating garment, i.e. tubular sleeve 100, which may be form fitting. The heating garment 100 is constructed from a plurality of layers of material generally referred to as 110.

A first layer L1 of the plurality of layers 110 is an inner-most layer. The first layer L1 is configured to be nearest skin 120 of a limb 120A which may be an arm. The first layer L1 may include a moisture-wicking material 130 (illustrated schematically). For example, the first layer L1 may be a thermal base layer.

A second layer L2 of the plurality of layers 110 may include a radiant heating source 140 (illustrated schematically). The second layer L2 is intended to provide deep heating.

A third layer L3 of the plurality of layers 110 may include a conductive heating source 150 (illustrated schematically). The third layer L3 is intended to provide surface or shallow heating of the skin 120.

A fourth layer L4 of the plurality of layers 110 may include a first insulator 160 (illustrated schematically). The fourth layer L4 is intended to reduce conducted and convective heat losses.

A fifth layer L5 of the plurality of layers 110 may include a second insulator 170 (illustrated schematically). The fifth layer L5 is intended to reduce radiated losses.

The plurality of layers 110 may each have high moisture transfer rates to reduce the humidity level inside the heating garment 100. The system 100 may provide deep radiant heat, vapor removal, thermal insulation, and radiant heat conservation. Thus, the system 100 may provide both a thermal and moisture regulating system.

The energy absorption rate by the surface of the skin 120, through skin tissues and blood, varies as a function of energy wavelengths. As energy is absorbed, a majority of the absorbed energy is converted to heat where it is absorbed in the body. Ionizing and tissue damaging radiation are associated with shorter ultraviolet wavelengths. Infrared (IR) wavelengths are non-ionizing and are considered a safe form of radiation.

IR wavelengths are more likely to be absorbed by the blood and deeper tissues and are less likely to be absorbed by the surface of the skin 120. This is similar to sunlight warming the floor of a house as it passes through a window. The result is greater warming of the blood and deeper tissues without raising the surface temperature of the skin 120 to dangerous or uncomfortable levels.

With respect to electromagnetic bands of the electromagnetic spectrum, one band of IR wavelength that is considered safe is between approximately 4 and 12 μm. This is within the far infrared (FIR) portion of the IR band. Another band of IR wavelength that is considered safe is between approximately 760 and 1440 nm. This is within the near infrared (NIR) portion of the electromagnetic spectrum. Mid infrared is between the near and far bands, i.e. 1.4 to 4 μm. In one embodiment, the system may apply FIR. In another embodiment, the system may apply NIR. In another embodiment, multiple bands of the IR spectrum may be applied sequentially and/or simultaneously by the same or different components of the system, as disclosed herein.

Materials, such as graphene, tourmaline, ceramic, carbon fiber, and others can efficiently generate IR wavelengths. Some of these materials can be manufactured directly into flexible sheets similar to common fabrics that can be used to construct the heating garment 100 for the second or third layer. Some of these IR emitting materials are more rigid and can be formed into small rigid shapes that can be attached to a fabric material similar to how buttons are attached to a shirt. In some embodiments, the heating garment 100 may incorporate flexible IR emitting sheets for layer (L2). In some embodiments, the heating garment 100 may incorporate fabrics with attached rigid IR emitting shapes for layer (L2). In some embodiments, the heating garment 100 may incorporate a combination of flexible IR emitting sheets and fabrics with rigid IR emitting shapes attached for layer (L2).

If blood temperature exceeds the surrounding tissue temperature, then heat will flow out of the blood to warm those areas. This is the intended result after the blood leaves the warming volume of the heating garment 100 and moves into the extremity, for example the hand. This can be considered a loss of efficiency when it occurs within the warming volume of the heating garment 100. In some embodiments, additional heating sources can be incorporated into the heating garment 100 to improve the system efficiency by heating at shallower depths including the surface of the skin 120. Such heating sources may be the sources 150 included in the third layer L3 to provide supplemental heat for slightly heading the skin. The surface heaters 150 may heat via conduction similar to an electric blanket, heating pad, or similar device. These surface heaters 150 may typically have some type of resistive element that generates heat through conduction. For example, the conduction may be predominately transferred to the skin 120 through one or more layers of surrounding material. Surface heaters may be comprised of a synthetic fabric mixed with conductive fibers. A commercially available fabric such as SEFAR PowerHeat available from Sefar INC. of Buffalo, N.Y., USA, is comprised of polyimide film to insulate a polyester and micro stainless-steel fiber fabric. When electricity is applied to this material, it generates heat. The material is washable, foldable, thin, lightweight and durable.

In some embodiments, these additional shallow heating sources of layer L3 may function at electromagnetic radiation wavelengths that are configured to be absorbed by the skin 120 near its surface. One of the electromagnetic bands with this property is between approximately 2 and 4 μm. In some embodiments, the shallow and deep heat of layer L2 or layer L3 will come from the same source, e.g., from a single layer. Thus, for example, layer L2A (FIG. 1). It is to be appreciated that when the layers are combined, rather than a vertically adjacent configuration of heating elements, the elements may be distributed on a single plane, such as in a weave or grid pattern, or the like. Radiation emitting materials may have a distribution of emitted wavelengths. For example, carbon fibers can emit energy across a broad band ranging from approximately 1 to 12 μm providing both shallow and deep heating simultaneously.

Figure 2:
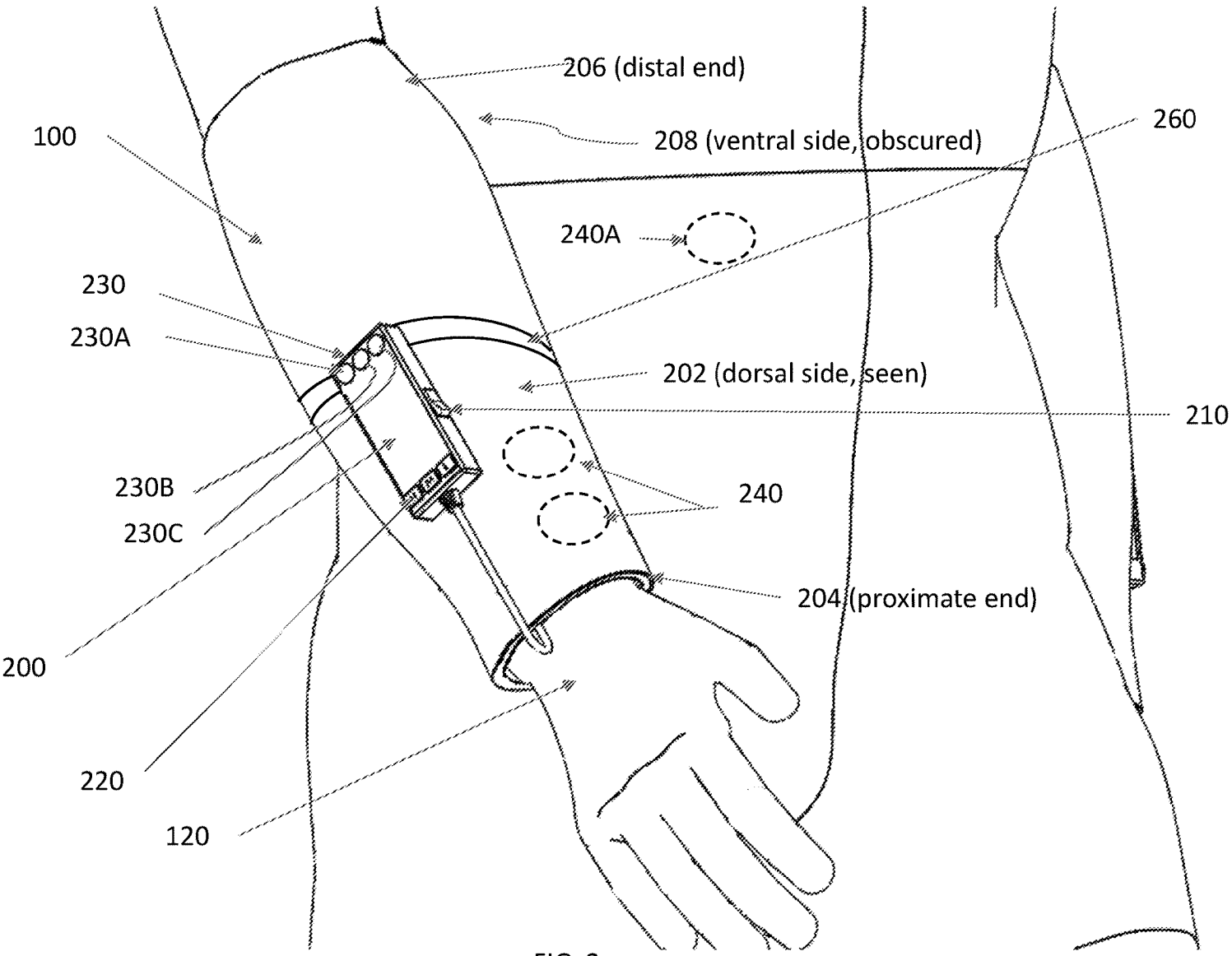
FIG. 2 shows a thermal regulation controller (TRC) of the heater, wherein the TRC is exiting at a wrist and being strapped to an arm, according to an embodiment.

A thermal regulation controller (TRC) 200 is illustrated in FIG. 2 mounted to a top side or dorsal-forearm side 202 of the heating garment 100, intermediate a front end or proximate end 204 and a back end or distal end 206. As the heating garment 100 is substantially cylindrical, the proximate end 204 axially opposes the distal end 206. It is to be appreciated that in use, the proximate end 204 is a wrist end and the distal end 206 is an elbow end. Further, the dorsal-forearm side 202 radially opposes a bottom side or ventral side 208 of the heating garment 100.

The TRC 200 includes electrical components and/or electronics for controlling the heating of the heating garment 100 including for example a thermostat. In some embodiments, the TRC 200 may control the heating of the heating garment 100 by starting, stopping, pulsing, throttling, duty cycling, or the like, to one or more of the heating elements simultaneously. In some embodiments, the TRC 200 can coordinate heating sequences to only energize a portion of the heating elements simultaneously. This can reduce the instantaneous peak energy consumption of the heating garment 100.

Figure 3:
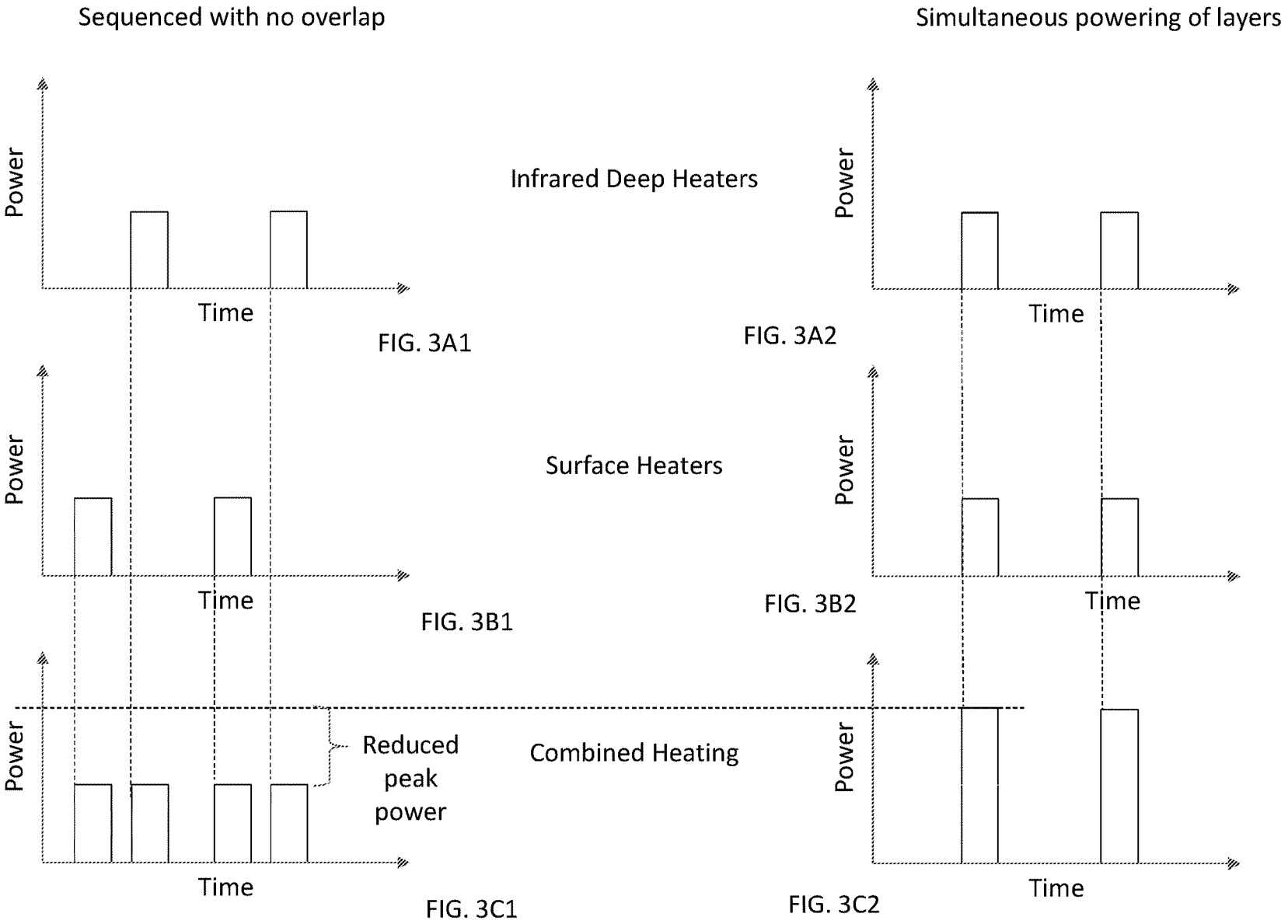

For example, the deep IR heaters (layer L2) can be cycled as illustrated in FIGS. 3A1 and 3A2, which illustrate power vs time. The surface heaters (layer L3) may be cycled as illustrated in FIGS. 3B1 and 3B2, which also illustrate power vs time. In FIGS. 3A1 and 3B1, the layer L2 and layer three L3 heaters are run in alternating sequences, one after another. The peak power draw at any one time, as illustrated in FIG. 3C1, is never greater than the power drawn by either layer at the same instance of time. In FIGS. 3A2 and 3B2, the layer L2 and layer three L3 heaters are synchronized, i.e., they run at the same time. The peak power draw at any one time, as illustrated in FIG. 3C2, is the summation of the power drawn by both layers at that same instance in time.

In some embodiments, the TRC 200 may incorporate a mechanism 210 (e.g. on/off toggle switch or illuminated push-button switch) to enable or disable the heating garment 100. A fabric embedded TRC 200A (FIG. 4) or fabric embedded switch 210A (FIG. 4), i.e., contained within in the heating garment 100 itself, are within the scope of the disclosure. Such embedded implements may be utilized in addition to or instead of the implements mounted to the heating garment 100.

In some embodiments, the TRC 200 may incorporate a selectable level mechanism 220. This could be a pushbutton to toggle through the low/med/high levels. This could be executed with a single pushbutton that, for example, has a multicolor LED to indicate which level they that is currently active (blue, yellow, red). The LED could be independent of the switch. Alternately, three independent LEDs could be used to uniquely indicate low, medium, and high settings.

This mechanism could allow the user to set a target temperature level. The mechanism 220 may be hi/med/low switch or thermostat dial.

In some embodiments, the TRC 200 may incorporate haptic feedback (e.g., any technology that can create an experience of touch by applying forces, vibrations, or motions to the user). In one embodiment, the haptic feedback includes vibrations provided by the TRC 200. This could be to provide feedback in response to a change in the selected target temperature level or a warning condition such as a low battery. The implement causing the vibration may be a piezoelectric transducer installed in the TRC 200. The feedback could be observed by engaging the selectable level mechanism 220 (FIG. 2), or by engaging the switch 210A (FIG. 4), which may be under the surface of the outer layer of the garment. Another way to receive haptic feedback is during an alert condition, such as in the form of a low voltage warning. The type of haptic feedback may change depending on the type of engagement with the system or alert being provided by the system. For example, if a user engages the TRC 200 by engaging a switch located about their forearm, through a jacket, to toggle between off/low/med/high settings (similar to an electric blanket), the system may provide a vibratory (buzzing) response to inform the user which target temperature level is being utilized. For example, a vibratory response may be in the form of different vibratory patterns, such as a single, double or triple (or short, medium, long) impulse responses. Similarly, a vibration pattern may indicate a power change state, such as powering on/off. The patters may be similar to a Morse-code style scheme for the different indications intended for representation. This disclosure is not intended on limiting the various types or utilization of the various types of feedback mechanisms.

In some embodiments, the TRC 200 may be detachable from the rest of the heating garment 100. For example, in some embodiments, the TRC 200 may attach to the rest of the heating garment 100 via a wired connector 270 that extends to the proximate end 204 over the dorsal side 202 of the heating garment 100. In some embodiments, the TRC 200 may be wirelessly connected to the rest of the heating garment 100. In some embodiments, the wireless connection may be an inductive coupling.

For example, electronics in the heating garment 100 and the TRC 200 would include inductive coupled power sources 280A, 280B, one of which is inductively energized by being in close proximity to the other. Once powered the two may communicate using radio frequencies powered by the inductive power source to exchange information such as power states and requirements. Power and communicating of information in this embodiment is akin to powering and communicating with an RFID chip.

In some embodiments, the TRC 200 can be attached to the forearm outside of all arm coverings. FIG. 2 shows an embodiment where the TRC 200 is connected to the rest of the heating garment 100 via the wired connector 270 that exits the heating garment 100 at the wrist. In some embodiments, the TRC 200 can be attached to the forearm using an adjustable strap 260 wrapping around the arm to secure the TRC 200. In some embodiments, the TRC 200 may incorporate device status indicators 230 (FIG. 2). The indicators 230 may include a first indicator light 230A for indicating indicate device status. Device status may be 'on/off'. The indicators 230 may include a second indicator light 230B to convey the heating status. Heating status may be 'warming/idle'. The indicators 230 may include a third indicator light 230C conveying energy status. Energy status may be percent of battery remaining indicator. One version is a 'battery low' LED, without percentages. The above discussion of possible indicators for 230 is not intended to be limiting or mutually exclusive.

Figure 4:
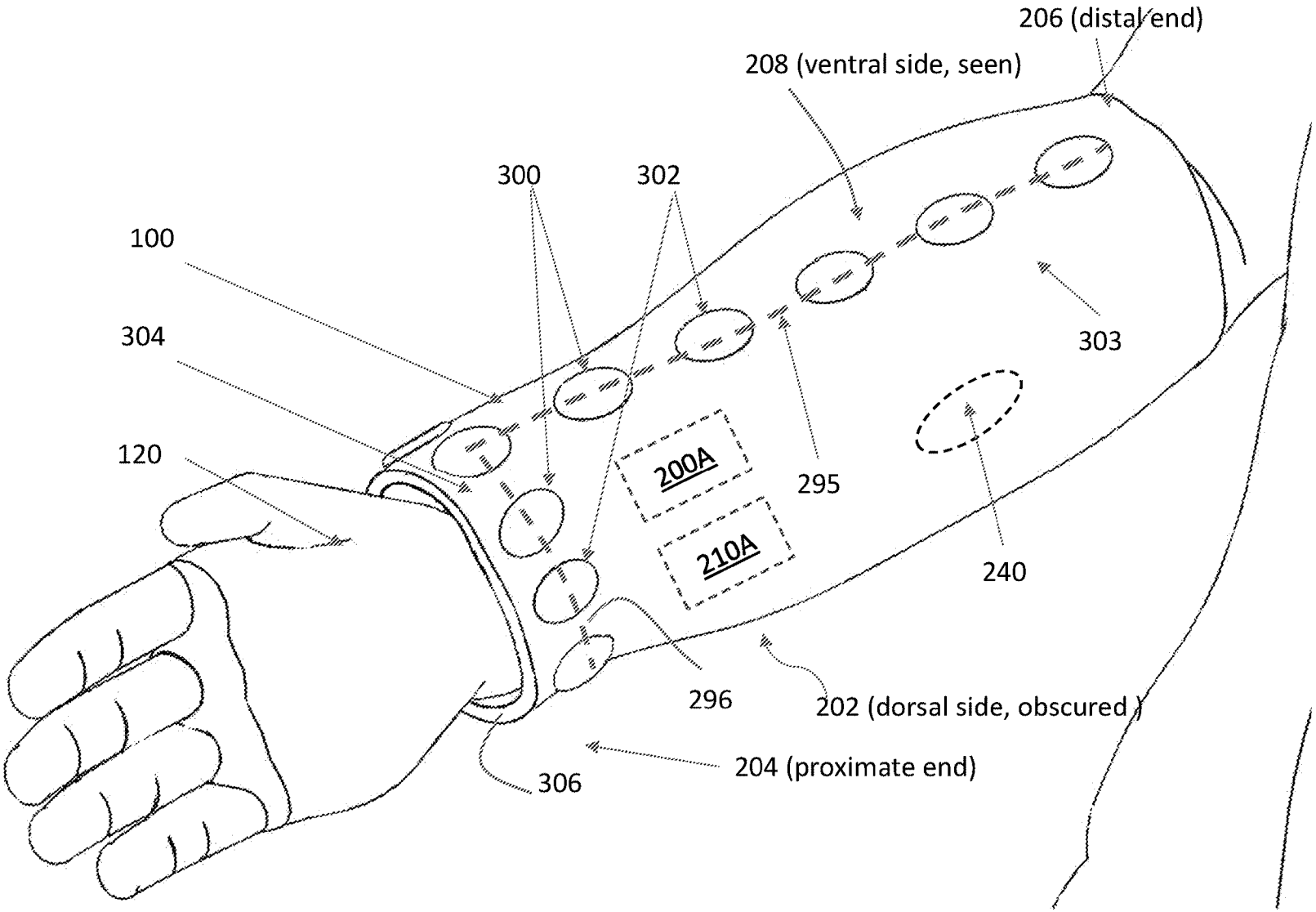
FIG. 4 shows the heater over an arm with conductive fabric and IR elements, according to an embodiment.

In some embodiments, the TRC 200 can vary the heating of the heating garment 100 over time without feedback (open loop control). In some embodiments, the TRC 200 can vary the heating of the heating garment 100 over time in response to feedback (closed loop control). In some embodiments, feedback may come from sensors 240 inside the heating garment 100 (FIGS. 2 and 4). These sensors may include temperature, humidity, the like, or combinations thereof. In some embodiments, the sensors 240 may be embedded in the heating garment 100. The sensors 240 may be located in layers L1 or L2 so as to be close to the skin. In some embodiments, the sensors 240 may be part of the TRC 200. In some embodiments, the sensors may be remotely located away from the heating garment 100 and the TRC 200. For example, a temperature sensor 240A may be located near the wearer's torso to monitor their core temperature. Such sensor 240A may be connected by wire or wirelessly. If the connection is wireless, the protocols that may be applied include Ant+, Bluetooth and other known personal area network protocols.

Figure 5:
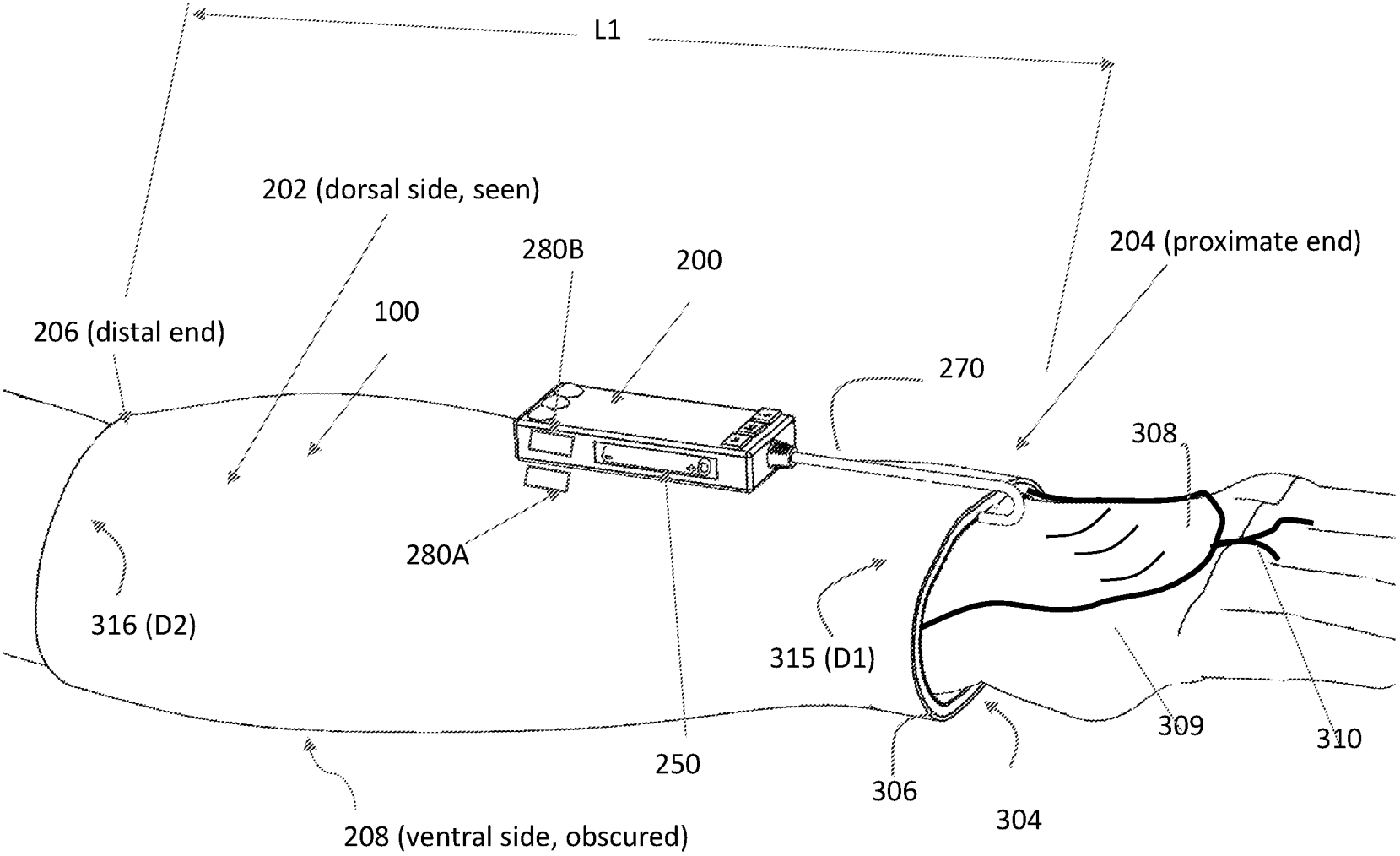
FIG. 5 shows additional features of the heating garment according to an embodiment.

Turning to FIG. 5, in some embodiments, an energy source 250 may be provided in the TRC 200 on the heating garment 100. The energy source 250 may be a stored energy source. A stored energy source may include, but not be limited to, battery technologies, fuel cells, combustible materials, exothermic reactive materials, nuclear based energy sources, capacitors, super capacitors, inductive energy storage, magnetic energy storage, springs, windings, other electrical storage methods, other chemical methods, other mechanical methods, or the like.

In some embodiments, the energy source 250 may be supplied by non-stored methods. Non-stored methods include, but are not limited to, solar energy, motion generated energy, or the like. In some embodiments, the energy source can be comprised of one or more energy sources, both passive and active.

In some embodiments, moisture wicking materials of the first layer L1 (FIG. 1) may be incorporated into the heating garment 100. This can reduce evaporative losses at the surface of the skin 120. In some embodiments, this layer L1 can manufactured from an elastic material. Thus, the layer L1 may provide a form fitting layer that increases contact with the skin 120 and reduces conducted thermal resistance.

In some embodiments, one or more of the layers, for example the fourth layer L4 (FIG. 1), may include insulating materials. This layer L4, including the insulating materials, may reduce conducted, convective, or combinations of the two mechanisms of heat loss. In some embodiments, this layer L4 can have high moisture transmission rates (i.e. breathable materials). Materials suitable for this layer L4 to achieve these goals may include fleeced polyester.

In some embodiments, one or more layers L5 (FIG. 1) may include radiant insulating materials. This layer L5, with the insulating materials, may reduce radiated heat losses. In some embodiments, this layer L5 may have high moisture transmission rates such as Celliant by Hologenix LLC of Santa Monica, Calif., USA.

In some embodiments, the heating materials of the second or third layers, L2 or L3 (FIG. 1), may encircle the forearm over the length of the heating garment 100. In some embodiments, the heating materials of these layers L2 or L3 may be selectively positioned along the length of the heating garment 100 over the major blood vessels of the forearm flowing towards the hand. As illustrated in FIG. 4, for example, the layout of the heating elements such as radiant elements 300 of layer L2 and/or conductive elements 302 of layer L3 may be disposed in a first pattern 295 extending on the ventral side 208 between the proximate end 204 and the distal end 206 of the heating garment 100 (FIG. 4). Such first pattern 295 is substantially linear and traces the orientation of the radial artery, the ulna artery, the arterioles, etc.

In some embodiments, the heating materials such as the radiant elements 300 of layer L2 and/or the conductive elements 302 of layer L3 may be disposed in a second pattern 296 along the proximate end 204 of the ventral side 208 of the heating garment 100, for example over a palmer-wrist area when worn. Such second pattern 296 may be substantially linear and perpendicular or near-perpendicular to the first pattern. Such area is proximate to an inner area of a forward cuff area 306 of the heating garment 100. Such patterns 295, 296 may be where the blood vessels are closer to the surface of the skin 120. As illustrated proximate end 204 on the ventral side 208 of the heating garment 100 may be a wrist-palmer area 304 of the forearm, that is, proximal to the wrist.

FIG. 4 shows a combination of embodiments with radiant elements 300, 302 following the major vessels, radiant elements surrounding blood vessels closer to the surface around the wrist, and shallow heating around the rest of the forearm. Elements 300, 302 are illustrated in an alternating pattern on both the first pattern 295 and the second pattern 296, though these patterns are not meant to be limiting.

As illustrated in FIG. 5, in some embodiments, at the proximate end 204 of the dorsal-side 202 of the heating garment 100, that is at the forward cuff area 306 and which opposes a ventral-wrist area 304, the heating garment 100 is formed with a proximate-extending dorsal section 308 to extend over the dorsal side or back of the hand 309. In addition, the fabric may have a "cling" characteristic to reduce heat loss. The proximate extending dorsal section 308 may be formed from a fabric flap. In some embodiments, one or more fabric loops or straps 310 are incorporated into the material extending proximately from a proximate end 311 of the proximate-extending dorsal section 308. These loops are placed over one or more fingers to support the proximate-extending dorsal section 308 on the back of the hand 309 and keep it in close proximity to the skin 120. These enhancements can help reduce the thermal losses on the back of the hand where the blood vessels are close to the surface with little or no impact on hand function.

It should be understood by those skilled in the art that the non-heating layers, including the first, fourth and fifth layers, L1, L4 or L5 (FIG. 1), described are optional and may be indirectly included by an independent layer of clothing. For example, the heating garment 100 may consist of heating elements that could be worn over a moisture wicking shirt and under a winter coat that has conducted, convective, and radiant insulation. In addition, the heating garment 100 may being integrated into a full clothing garment, such as a shirt, a form-fitting jacket, and/or a set of long underwear (see FIG. 6 and the related disclosure, below). Combined in this way, all of the layers would be present. It should further be understood that the non-heating layers improve the system efficiency but are not required for the system to work.

The above embodiments provide a heating garment 100 that, when warn as a sleeve, may enable a person to have warm bare hands in cold weather. If conditions require gloves, a thinner layer of glove may be utilized than if the warming garment 100 were not worn.

The heating garment 100 may be manufactured with an upper or proximate opening 315 and a lower or distal opening 316, having respective diameters D1, D2 and separated by a length LTH1. Those parameters may enable fitting on forearms of people, from children to adults, and animal leg. Wearing around a calf of a person to heat feet is within the scope of the disclosure. That is, the heating garment 100 is configured to fit an appendage of various kinds of animals to provide heat to its distal extremity.

Figure 6:
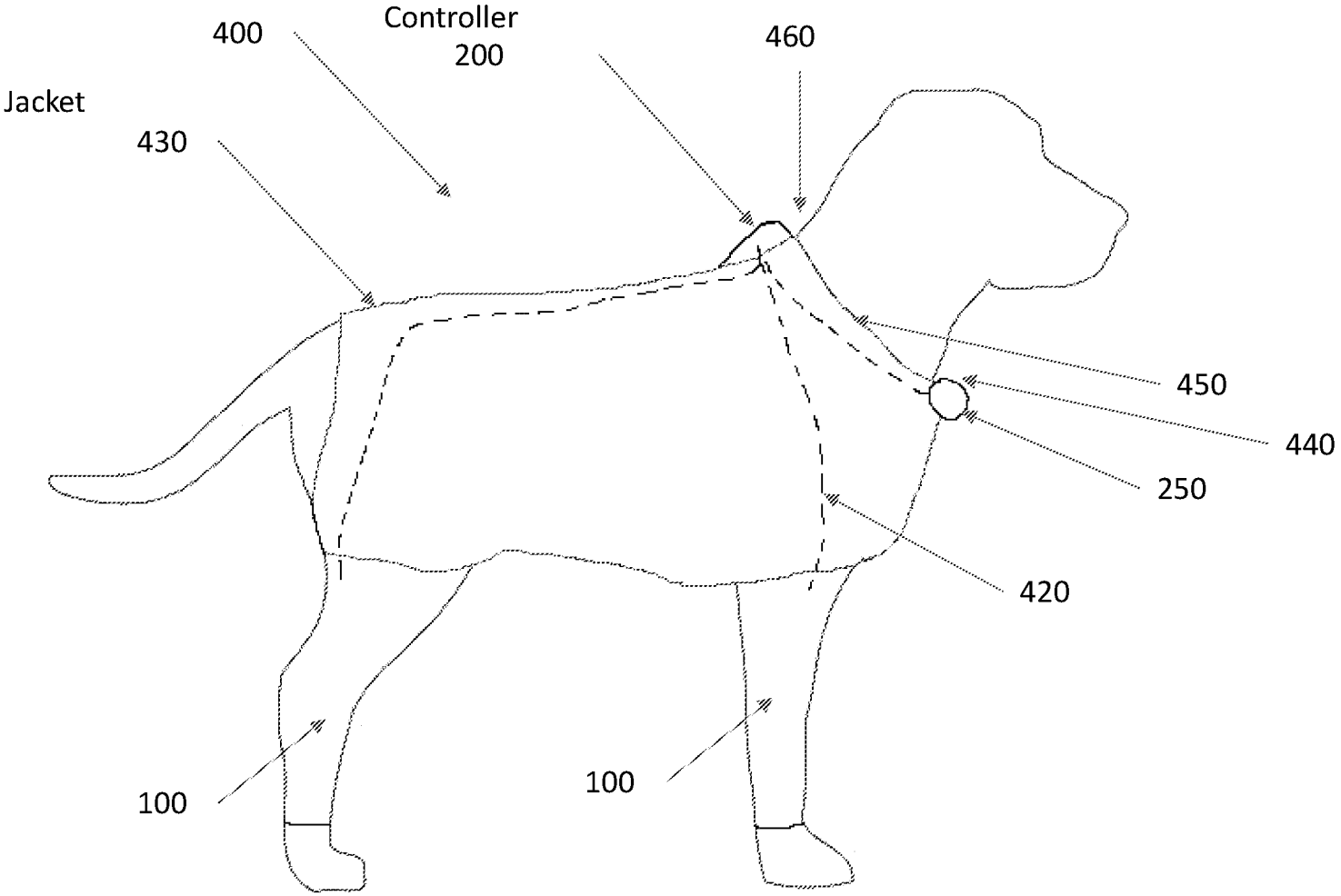
FIG. 6 shows the heating garment on an animal, wherein a clothing garment includes a plurality of the heating garments.

For example, turning to FIG. 6, the heating garment 100 may be worn around the legs of a dog. FIG. 6 illustrates a version of the heating system 400 having a plurality of garments 100 connected by straps 420 that include power cables connected to an energy source 250 otherwise worn by the wearer. The straps 420 may be encased in a clothing garment 430, which may be a unitary or integrated garment, which in FIG. 6 is a dog jacket. The power source 250 and a TRC 200 may be mounted to the clothing garment 430. In this instance the power source is worn against front 440 of a neck opening 450 of the clothing garment 430 and the TRC 200 is mounted at a back 460 of the neck opening 450, for example, to provide ease of access to an attendant of the animal. Each of the heating garments 100 are configured with appropriate lengths and dimeters to fit the legs of the animal. As can be appreciated the clothing garment 430 may not need straps to keep the plurality of garments 100 connected to it. Instead the heating garments 100 may be individually sewn to different areas of the clothing garment 430, similarly as arms of a jacket are sewn to a body portion of a jacket. In addition, as indicated, the clothing garment 430 may take other forms such as such as a shirt, a form-fitting jacket, and/or a set of long underwear that may be worn by a person.

Figure 7:
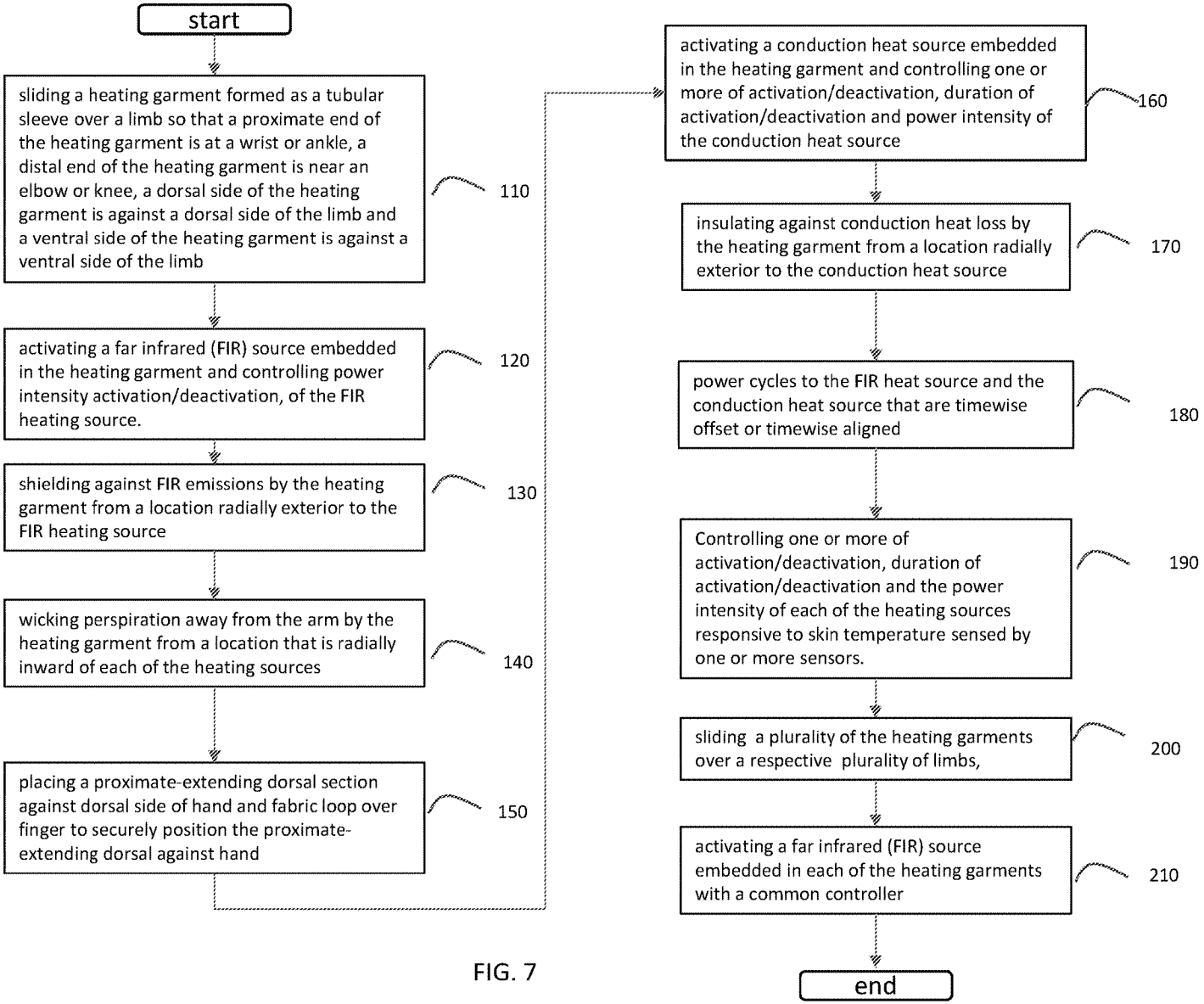
FIG. 7 is a flowchart illustrating a method of heating an extremity.

Turning to FIG. 7, a flowchart shows a method of distributing heat to an extremity. As illustrated in block 110 the method includes sliding a heating garment in the form of an open ended tubular sleeve over a limb so that a proximate end of the heating garment is at a wrist or ankle, a distal end of the heating garment is near an elbow or knee, a dorsal side of the heating garment is against a dorsal side of the limb and a ventral side of the heating garment is against a ventral side of the limb. As shown in block 120 the method includes activating an infrared (IR) source embedded in the heating garment and controlling one or more of activation/deactivation, duration of activation/deactivation, and power intensity of the IR heating source. As shown in block 130 the method includes shielding against IR emissions by the heating garment from a location radially exterior to the IR heating source.

As shown in block 140 the method includes wicking perspiration away from the arm by the heating garment from a location that is radially inward of each of the heating sources. As shown in block 150 the method includes placing a proximate-extending dorsal section against dorsal side of hand when worn on an arm and fabric loop over finger to securely position the proximate-extending dorsal against hand.

As shown in block 160 the method includes activating a conduction heat source embedded in the heating garment and controlling one or more of activation/deactivation, duration of activation/deactivation, and power intensity of the conduction heat source. As shown in block 170 the method includes insulating against conduction heat loss by the heating garment from a location radially exterior to the conduction heat source.

As shown in block 180 the method includes applying power cycles to the FIR heat source and the conduction heat source that are timewise alternating or timewise synchronized. As shown in block 190 the method includes controlling one or more of activation/deactivation, duration of activation/deactivation, and power intensity of each of the heating sources responsive to skin temperature sensed by one or more sensors.

As shown in block 200 the method includes sliding a plurality of the heating garments over a respective plurality of limbs. As shown in block 210 the method includes controlling one or more of activation/deactivation, duration of activation/deactivation, and power intensity of the IR heating source with a single controller operationally connected to each of the plurality of heating garments.

As described above, embodiments can be in the form of processor-implemented processes and devices for practicing those processes, such as a processor. Embodiments can also be in the form of computer program code containing instructions embodied in tangible media, such as network cloud storage, SD cards, flash drives, floppy diskettes, CD ROMs, hard drives, or any other computer-readable storage medium, wherein, when the computer program code is loaded into and executed by a computer, the computer becomes a device for practicing the embodiments.

Embodiments can also be in the form of computer program code, for example, whether stored in a storage medium, loaded into and/or executed by a computer, or transmitted over some transmission medium, loaded into and/or executed by a computer, or transmitted over some transmission medium, such as over electrical wiring or cabling, through fiber optics, or via electromagnetic radiation, wherein, when the computer program code is loaded into and executed by a computer, the computer becomes an device for practicing the embodiments. When implemented on a general-purpose microprocessor, the computer program code segments configure the microprocessor to create specific logic circuits.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

Those of skill in the art will appreciate that various example embodiments are shown and described herein, each having certain features in the particular embodiments, but the present disclosure is not thus limited. Rather, the present disclosure can be modified to incorporate any number of variations, alterations, substitutions, combinations, subcombinations, or equivalent arrangements not heretofore described, but which are commensurate with the scope of the present disclosure. Additionally, while various embodiments of the present disclosure have been described, it is to be understood that aspects of the present disclosure may include only some of the described embodiments. Accordingly, the present disclosure is not to be seen as limited by the foregoing description but is only limited by the scope of the appended claims.

We claim:

1. A heating system comprising:

a heating garment formed as a tubular sleeve, the heating garment configured for being worn on a limb, having a cylindrical shape, a proximate end, a distal end that is axially spaced form the proximate end, a dorsal side and a ventral side that radially opposes the dorsal side, a proximate opening at the proximate end, and a distal opening at the distal end, wherein the heating garment is configured for being slid over the limb so that the proximate end is at one of a wrist or ankle, the distal end is near a corresponding one of an elbow or knee, the dorsal side covers a dorsal side of the limb and the ventral side covers a ventral side of the limb, the heating garment including heating elements that include an infrared radiation (IR) heating source that radiates IR along at least a portion of the heating garment and a conduction heating source that conducts heat along at least a portion of the heating garment so that one of the IR heating source and the conduction heating source releases heat to warm blood vessels and tissue surrounding the blood vessels;

wherein the IR heating source is distributed in a first pattern and a second pattern, wherein the conduction heating source is arranged along one or both of the first pattern and the second pattern, the first pattern being a single linear array of the heating elements extending between the proximate end and the distal end of the ventral side of the heating garment, the second pattern being another single linear array of the heating elements extending about the proximate end of the ventral side of the heating garment, wherein the heating elements are arranged only along the first and second patterns such that the heating garment has only two linear arrays of heating elements;

wherein the first pattern and the second pattern are approximately perpendicular with respect to each other, wherein, in operation:

the conduction heating source applies heat to shallower depths than the IR heating source, to thereby heat a surface of skin of the limb that is under the garment and near the conduction heating source; and the IR heating source applies heat to deeper depths than the conduction heating source, to thereby heat tissue under the surface of the skin and blood within and under the tissue.

2. The system of claim 1, wherein the heating garment includes IR heating shielding disposed radially exterior to the IR heating source.

3. The system of claim 2, including:

a proximate-extending dorsal section extending from the proximate end of the dorsal side, the proximate-extending dorsal section being configured for extending over a dorsal side of a hand when worn on an arm; and a fabric loop extending from a proximate end of the proximate-extending dorsal section, the fabric loop configured for being looped about a finger when worn on the arm, to thereby securely position the proximate-extending dorsal section against the proximate side of the hand when worn on the arm.

4. The system of claim 1, including a controller that is a thermal regulation controller, the controller being operationally connected to the IR heating source, the controller controlling operational parameters of the IR heating source including one or more of activation/deactivation, duration of activation/deactivation, and power intensity, wherein the controller is adjustably securable to the heating garment.

5. The system of claim 4, wherein the controller is operationally connected to the conduction heating source, the controller controlling operational parameters of the conduction heating source including one or more of activation/deactivation, duration of activation/deactivation, and power intensity.

6. The system of claim 5, wherein the controller is configured to applying power cycles to the IR heating source and the conduction heating source that are timewise alternating or timewise synchronized.

7. The system of claim 5, wherein the heating garment includes a moisture wicking layer disposed radially inward of each of the heating sources.

8. The system of claim 5, including one or more sensors operationally connected to the controller and removed from the heating garment, wherein the controller controls each of the heating sources responsive to temperature of skin sensed by the one or more sensors.

9. The system of claim 4, comprising a plurality of the heating garments configured for being worn on a plurality of limbs, each of the plurality of heating garments being operationally connected to the controller.

10. A clothing garment comprising the system of claim 9, wherein wires interconnect the plurality of heating garments and the controller, and wherein the wires are embedded in the clothing garment.

11. A method of distributing heat to an extremity comprising:

sliding the heating garment of the system of claim 1, formed as the tubular sleeve, over a limb so that the proximate end of the heating garment is at the one of the wrist or ankle, the distal end of the heating garment is near the corresponding one of the elbow or knee, the dorsal side of the heating garment is against a dorsal side of the limb and the ventral side of the heating garment is against a ventral side of the limb; and activating the IR heating source embedded in the heating garment and controlling one or more of activation/deactivation, duration of activation/deactivation, and power intensity of the IR heating source.

12. The method of claim 11, comprising shielding against IR emissions by the heating garment from a location radially exterior to the IR heating source.

13. The method of claim 12, comprising one or more of:

wicking perspiration away from the arm by the heating garment from a location that is radially between each heating source and the skin; and placing a proximate-extending dorsal section against dorsal side of hand when worn on an arm and fabric loop over finger to securely position the proximate-extending dorsal against hand.

14. The method of claim 12, comprising activating the conduction heating source embedded in the heating garment and controlling one or more of activation/deactivation, duration of activation/deactivation, and power intensity of the conduction heating source.

15. The method of claim 14, comprising insulating against conduction heat loss by the heating garment from a location radially exterior to the conduction heating source.

16. The method of claim 14, comprising applying power cycles to the IR heating source and the conduction heating source that are timewise alternating or timewise synchronized.

17. The method of claim 16, comprising controlling one or more of activation/deactivation, duration of activation/deactivation, and power intensity of each of the heating sources responsive to skin temperature sensed by one or more sensors.

18. The method of claim 11, comprising sliding a plurality of the heating garments over a respective plurality of limbs, and controlling one or more of activation/deactivation, duration of activation/deactivation, and power intensity of the IR heating source with a single controller operationally connected to each of the plurality of heating garments.

19. The system of claim 1, wherein the IR and conduction heating sources are arranged along the first and second patterns to overlap with each other.

20. The system of claim 19, wherein, in operation:

the second pattern of the IR and conduction heating sources heats the surface of the skin, tissue under the surface of the skin, and blood within and under the tissue around the one of the wrist or ankle; and the first pattern of the IR and conduction heating sources heats the surface of the skin, tissue under the surface of the skin, and blood within and under the tissue between the one of the wrist or ankle and a corresponding one of the elbow or knee, including blood flowing in an artery extending between the one of the wrist or ankle and corresponding one of the elbow or knee.

* * * * *